United States Patent [19]

Mental

[11] Patent Number: 4,617,195

[45] Date of Patent: Oct. 14, 1986

[54] SHIELDED ELECTROLUMINESCENT LAMP

[75] Inventor: Richard W. Mental, Indianapolis, Ind.

[73] Assignee: Microlite, Inc., Westfield, Ind.

[21] Appl. No.: 644,273

[22] Filed: Aug. 27, 1984

Related U.S. Application Data

[63] Continuation-in-part of Ser. No. 593,578, Mar. 26, 1984.

[51] Int. Cl.[4] ..... B05D 5/12

[52] U.S. Cl. ..... 427/66; 427/64; 313/51; 313/503; 313/506; 313/498; 313/510; 313/512

[58] Field of Search ..... 427/66, 64; 313/510, 313/512, 506, 503, 51, 498

[56] References Cited

U.S. PATENT DOCUMENTS

| | | | |
|---|---|---|---|
| 3,110,837 | 11/1963 | Wollentin | 427/66 |
| 3,205,393 | 9/1965 | Mash | 313/509 |
| 3,315,111 | 4/1967 | Jaffe et al. | 313/503 |
| 3,580,738 | 5/1971 | Ranby | 427/66 |
| 4,138,620 | 2/1979 | Dickson | 313/512 X |
| 4,513,023 | 4/1985 | Wary | 313/503 X |

*Primary Examiner*—John D. Smith
*Assistant Examiner*—Janyce A. Bell
*Attorney, Agent, or Firm*—Barnes & Thornburg

[57] ABSTRACT

A method for forming electroluminescent devices is disclosed. A first conductor is deposited on a substrate in a preselected pattern so as to form a first electrode. A first portion of the first conductor is then covered with a luminescent coating. A pair of second conductors are then deposited adjacent to each other, one of the second conductors forming a second electrode and contacting only the luminescent coating and the substrate, while the other second conductor contacts only the first conductor and the substrate. An insulative film is then deposited so as to cover the pair of second conductors. A conductive shielding layer is then deposited over the insulating film. The shielding layer includes a terminal portion adapted to be connected to a suitable ground.

11 Claims, 8 Drawing Figures

SHIELDED ELECTROLUMINESCENT LAMP

This application is a continuation-in-part of Ser. No. 06/593,578 filed March 26, 1984.

This invention relates in qeneral to electroluminescent cells, lamps, and panels, which devices generate light in response to an applied electrical signal. The invention particularly relates to such devices having an integral shielding layer so as to permit use of the device in close proximity to other circuits which may be responsive to said applied electrical signal. The invention also pertains to a unique method for constructing electroluminescent devices having inherent manufacturing simplicity and superiority.

Electroluminescent devices in the form of lamps or panels are themselves well known. A typical device comprises a finely divided phosphor dispersed in a binder and distributed in a thin layer between two plate or sheet electrodes, at least one of the electrodes being substantially transparent. The application of an electrical signal to the two electrodes causes the phosphor material to emit light, part of which is directed outwardly through the substantially transparent electrode.

An electroluminescent apparatus of the present invention includes a substrate with a first conductor or electrode fixed to substrate in a preselected pattern. A luminescent coating covers a first portion of the first conductor leaving a second portion of the first conductor uncovered. A pair of second conductors can be simultaneously situated in spaced adjacent relationship on the substrate. One of the second conductors extends over the luminescent coating while the other of the second conductors contacts the uncovered portion of the first conductor. The pair of second conductors form leads leading from the luminescent area or body of the device to a terminal portion where pin elements are affixed in a manner compatible with standard dimensioned plugs.

Apparatus of this general type are typically powered by a supply having an output signal in the audio frequency range, preferably about 800 hertz. When such an apparatus is used in close proximity with audio amplifiers or other circuits which may be responsive to a signal of such a frequency, some shielding must be employed to prevent interference. While the shielding can be incorporated in separate physical structure, it is desirable to have the shielding be an integral part of the electroluminescent lamp so as to insure reliability of performance. An integral incorporation of shielding with the lamp permits a total lower cost construction and generally quicker assembly than would be experienced with a separate shield assembly.

The method used to form devices of the present invention utilizes a substrate which can be formed to include a body portion and a lead portion. The first conductor which forms one of the electrodes is deposited on the body portion of the substrate in a preselected pattern. The luminescent coating covers a first portion of the first electrode, the first portion comprising only those areas which are intended to be excited by an applied electrical signal so as to emit light. A second portion, usually a peripheral portion, of the first conductor is left uncovered by the luminescent coating. A pair of second conductors can then be simultaneously deposited adjacent to each other. One of the pair of second conductors extends over the luminescent coating to form the second electrode while the other of the pair of second conductors contacts only the first portion of the first electrode. Both of the second conductors can unitarily extend from the body portion linearly along the lead portion of the substrate to form a two-conductor lead of preselected length which terminates at the distal end of the lead portion of the substrate.

The entire apparatus is covered by an insulative coating. The insulative coating acts as a barrier to prevent later ingress of moisture or other elements which. if not excluded, contribute to failure of the device. The insulative layer also permits the device once formed to experience greater physical manipulation without failure. A shielding layer is then deposited over the insulative layer. The shielding layer is substantially coextensive with the insulative layer but preferably extends over the terminal portion of the conductor leading to the second electrode. Alternatively, the shielding layer can be formed to include a third terminal preferably adjacent the terminal portions of the second conductors. Pin elements or other similar contacts are then attached to the ends of the pair of second conductors and shielding layer in a manner which assures uniform separation and thus plug compatibility of the device so formed. An additional protective layer can be applied over the shielding layer either before or after attachment of the pin elements.

One feature of the present invention is the coincident contact formed by the superpositioning of the terminal portions of one of the second conductors and the shielding layer. The grounding of this contact assures an effective shielding of the electrical signal applied to the lamp thereby preventing interference with desirable signals being processed by adjacent circuitry.

An advantage of the present invention is that a number of devices can be simultaneously formed on a large single sheet of substrate which is thereafter diecut to form the individual luminescent devices. The pin elements or other contact devices can be attached using conventional contact stapling techniques with high reliability of both dimensional tolerance and electrical continuity.

Additional features and advantages of the invention will become apparent to those skilled in the art upon consideration of the following detailed description of a prefered embodiment exemplying the best mode of carrying out the invention as presently preceived. The detailed description particularly refers to the accompanying figures in which.

Figure 8:
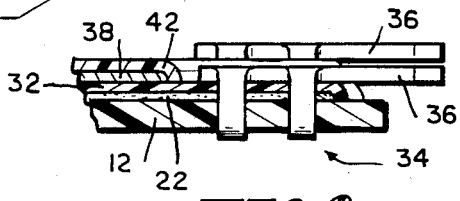
FIG. 8 is a sectional view similar to FIG. 7 showing the addition of a protective overlayer and a terminal pin.

An electroluminescent device 10 in accordance with the present invention is illustrated in the various stages of its construction in FIGS. 1 through 5 and in final form in FIG. 8. While each of the FIGS. 1—6 illustrate only a single device 10, it will be appreciated that a plurality of similar devices 10 can be formed simultaneously on a single substrate 12, the devices being separated from each other at a later stage in the manufacture. The device 10 comprises a substrate 12 onto which is deposited a first conductor or electrode 14 which can be deposited in a plurality of discrete areas. A luminescent coating 16 covers a first substantial portion 18 of the first conductor 14 while leaving a second generally peripheral portion 20 of the first conductor 14 uncovered. The luminescent coating is similarly positionable on a plurality of discrete areas. One portion 19 of the luminescent coating 16 extends beyond an edge 13 of the first electrode 14.

A pair of second conductors 22 and 24 are deposited adjacent to each other. The second conductor 22 is deposited so as to contact portion 19 and substantially cover the luminescent coating 16 to form a second electrode 26 parallel to the first electrode formed by first conductor 14. The second conductor 22 can form bridges 23 between various second electrodes 26. The second conductor 24 is deposited so as to contact only the substrate 12 and the first conductor 14 in the second or pheripheral portion 20. The second conductor 24 thus forms an electrical lead or bus 25 for the first electrode 14.

Figure 5:
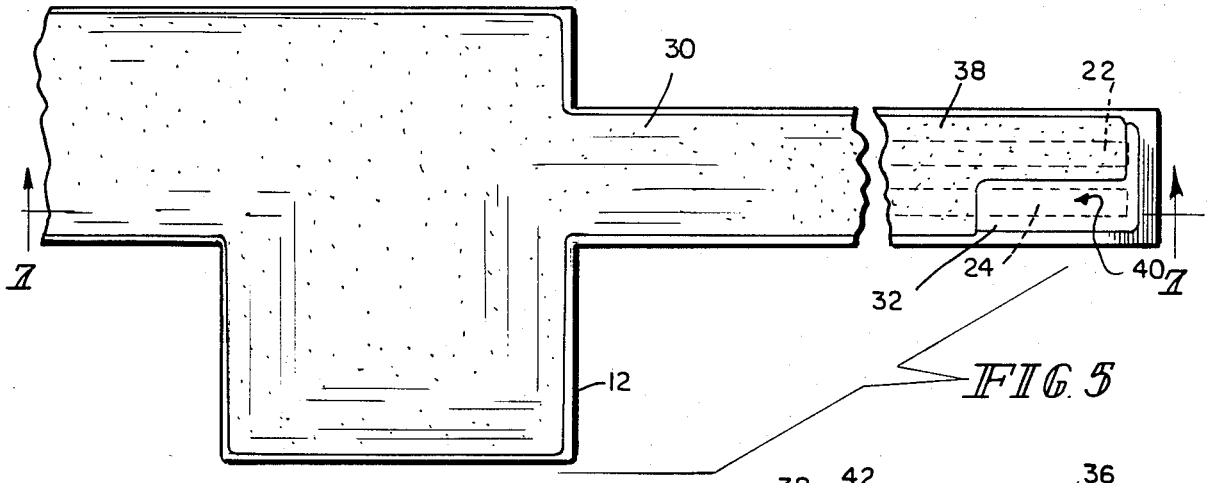
FIG. 5 is a plan view showing the shielding layer deposited coextensively with the insulative layer and extending over the terminal portion of one of the second conductors.
Figure 6:
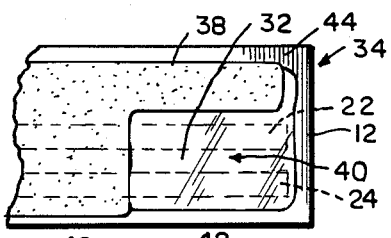
FIG. 6 is a plan view similar to FIG. 5 showing an alternative embodiment with the shielding layer forming a third terminal.

An insulative layer 32 is deposited or positioned over the second conductors 22 and 24 so as to cover substantially all of the device 10. A shielding layer 38 is then deposited over substantially the entirety of the insulative layer 32 except for a free edge 40 adjacent the terminal end of one of the second conductors such as conductor 24. As shown in FIG. 5, the shielding layer 38 extends over the terminal end of conductor 22 which forms the second electrode 26. In an alternative embodiment shown in FIG. 6, the shielding layer is extended to form a third terminal 44 adjacent to but insulated from conductors 22 and 24 by free edge 40 of insulative layer 32. A protective coating 42 can be applied over the shielding layer 38 as shown in FIG. 8 to protect it from abrasion and corrosion which might degrade its electrical performance.

The substrate 12 is shown to comprise a body portion 28 and a lead portion 30. While lead portion 30 is shown to extend outside the general periphery of the body portion 28, devices can be formed having lead portions within the periphery of the body portion 28. The substrate is preferably formed of a flexible transparent sheet material composed of a polymeric resin which is sufficiently form stable to prevent any mechanical stretching which might destroy the continuity of the various coated layers placed on that substrate. An example of a satisfactory material is a polyester such as biaxially oriented polyethelene terephthalate (PET) The body portion 28 and lead portion 30 are unitary and in general are cut from a single sheet of about 0.005 to 0.007 inch thickness subsequent to the disposition of the various layers disclosed herein.

The first conductor 14 comprises generally a substantially transparent metal oxide film which is spaced inwardly from the edge of substrate 12. Suitable metal oxide films can be formed of tin oxide, indium oxide, or nickel oxide with indium tin oxide being preferred. Metal oxide films having an optical transmittance of 60% or greater can be achieved while maintaining electrical continuity throughout the layer, the layer having a sheet resistance of less than about 2000 ohms per square. The metal oxide film is preferably formed by silk screening a solvent solution of a polyester resin containing the metal oxide on to the substrate 12. Alternatively, the metal oxide film may be formed in accordance with the general practices of U.S. Pat. No. 3,295,002.

Figure 7:
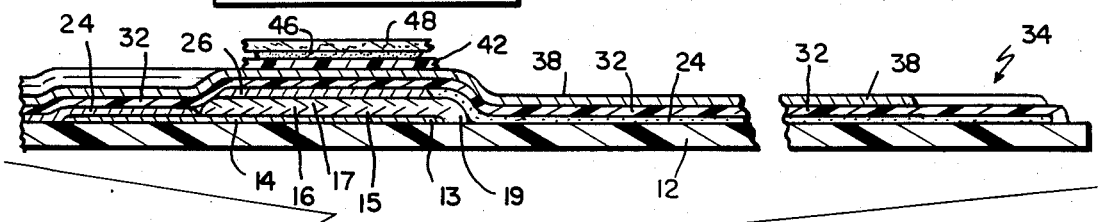
FIG. 7 is a sectional view taken along line 7—7 of FIG. 5.

The luminescent coating 16 is shown to cover substantially the whole of the first conductor 14 leaving only an edge portion 20 of the first conductor 14 exposed. The luminescent coating 16 generally comprises a light emitting layer 15 and an insulative, light reflecting layer 17 as shown in FIG. 7. The light emitting layer 15 generally comprises a mixture of a phosphor and a binder. The phosphor may be an inorganic compound such as zinc sulfide or zinc oxide combined with suitable activators such as copper, manganese, lead or silver. Alternatively, the phosphor may be an organic luminescent agent such as anthracene, napthalene, butadiene, acridine or other similar material. The phosphor is mixed with a suitable binder which is selected to be compatible with the phosphor. Examples of suitable binders are polyvinyl chlorides, cellulose acetate, epoxy cements, and other similar materials. Particularly useful binders include cyanoethyl cellulose and ethyl hydroxyethyl cellulose.

The light reflective layer 17 is generally a mixture of a light reflective opacifier in a matrix which is itself a dieletric. The layer preferably has a dielectric constant of about 10 or greater, and a breakdown strength of at least 800 volts/mil. The reflective opacifier is generally a metal oxide powder such as titanium oxide, lead oxide or barium titanate in a resin matrix of acrylic, epoxy, or other suitable resin. The relative positioning of layers 15 and 17 is such that light is emitted from the device 10 through the substrate 12.

The pair of second conductors 22 and 24 are deposited, preferably simultaneously, so as to be positioned side by side on the lead portion 30 of the substrate 12. One of the second conductors 22 unitarily extends on top of the luminescent coating 16 so as to form the second electrode 26. The other second conductor 24 extends merely over the second portion 20 of the first conductor 14 which was left uncovered by the luminescent coating 16. The second conductor 24 is spaced from the luminescent coating by a distance sufficient to insure electrical isolation of the first electrode 14 and second conductor 24 from the second electrode 26. The second conductors 22 and 24 including the second electrode portion 26 of second conductor 22 are formed of a particulate metal in colloidal form which is deposited in combination with an evaporable medium leaving behind a conductive film of particulate metal. A suitable material is a silver conductive coating material commercially available from Atcheson Colloids Company, Port Huron, Michigan, under part name Electrodag 426SS. Other types of fluid silver conductive materials are commercially available which may perform satisfactorily.

Figure 1:
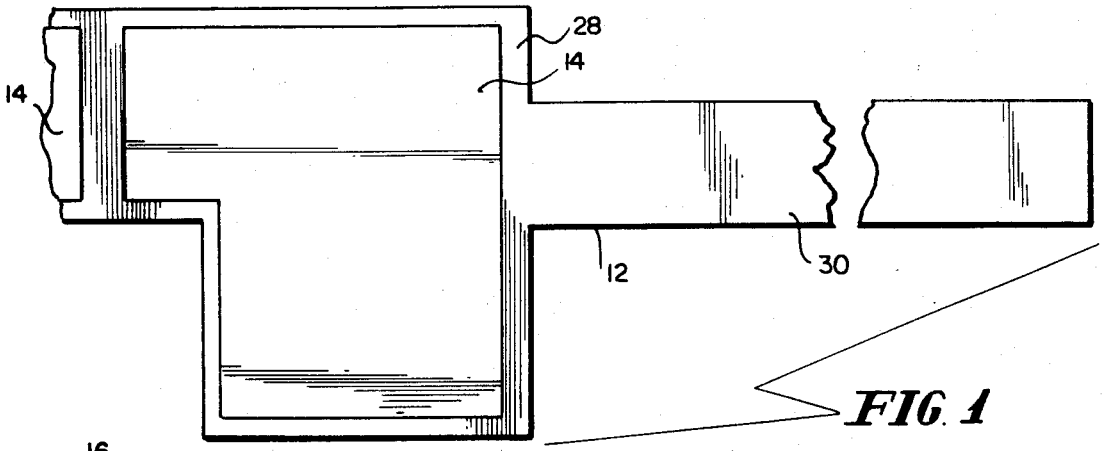
FIG. 1 is a plan view showing the substrate and first conductor deposited in a preselected pattern.
Figure 2:
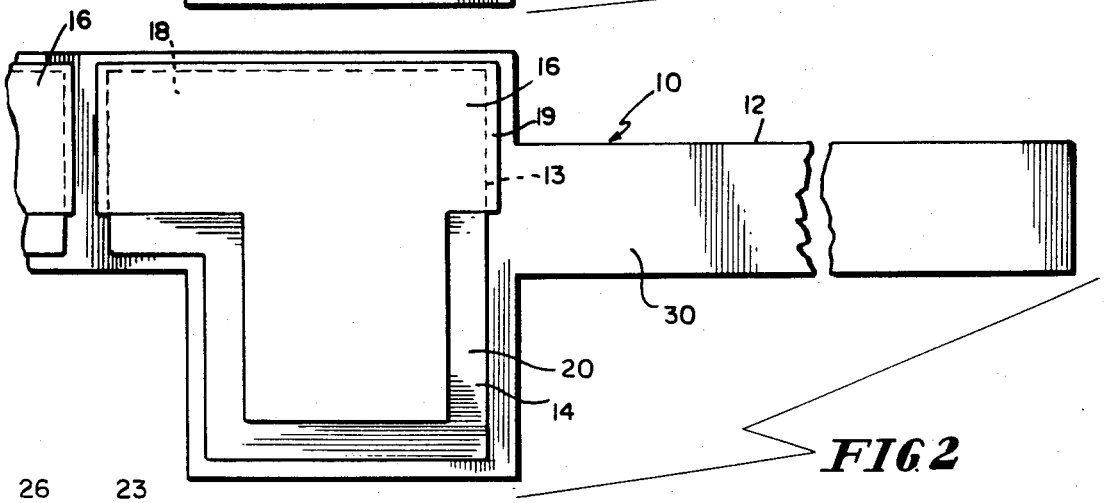
FIG. 2 is a plan view showing the positioning of the luminescent coating over the first conductor so as to leave at least one edge of the first conductor uncovered.
Figure 3:
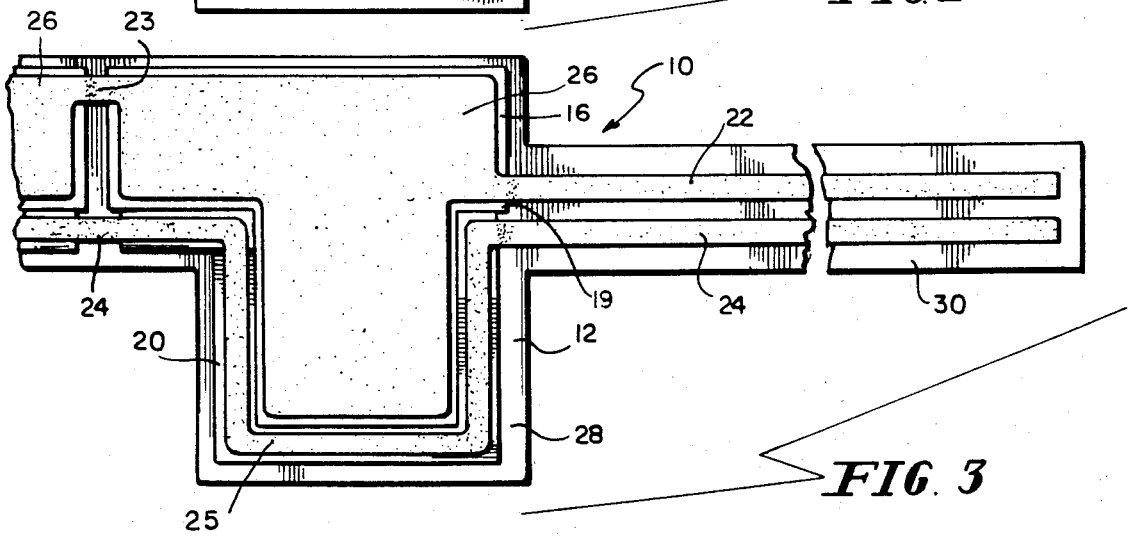
FIG. 3 is a plan view showing the deposition of the pair of second conductors adjacent to each other with one conductor contacting the luminescent coating and the other conductor contacting the first electrode.
Figure 4:
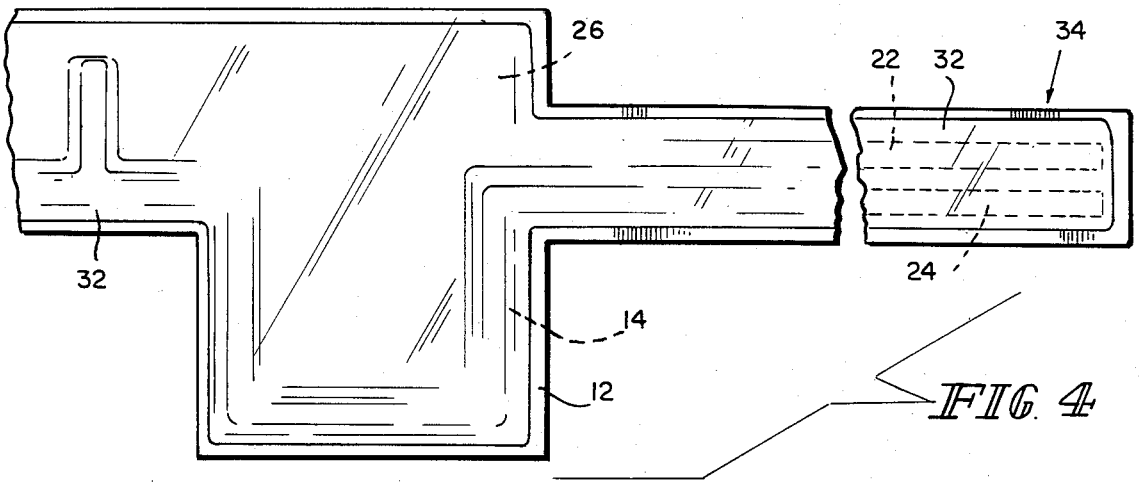
FIG. 4 is a plan view showing the insulative coating deposited over the entirety of the apparatus except the terminal portions of the pair of second conductors.

An insulative coating 32 is applied over the top of the various layers previously described to cover the entirety of the device as shown in FIG. 4. The insulative coating 32 preferably has a low dielectric constant of less than about 4 which acts to minimize the capacitve coupling from the circuit formed by the various layers 14, 16, 22, and 24 to the shielding layer 38. While low to medium density polyethylene and polymethylpentine materials generally may be satisfactory to form this layer, a particularly advantageous material is a biaxially oriented PET film coated on one side with about 0.001 inch of a cross linking acrylic adhesive such as 3-M No. 467.

A shielding layer 38 is applied on top of and substantially coextensive with the insulative coating 32 as shown in FIGS. 5–8. In one preferred embodiment shown in FIG. 5, the shielding layer 38 extends over the terminal portion of conductor 22. In another embodiment shown in FIG. 6, the shielding layer 38 includes a separate terminal 44 which can be attached to an appropriate ground to effect the desired shielding. In either embodiment the shielding layer can comprise a metal foil or metalized plastic film which can be cut to shape and directly applied, or a particulate metal in colloidal form which is deposited in a manner similar to conductors 22 and 24. A suitable metalized plastic film is available in conjunction with easily handled release sheets from Flexcon, Inc. of Spencer, Mass. under part MM-100. A suitable particulate metal colloid is that indicated previously for conductors 22 and 24.

As shown in FIG. 8, a protective overcoat 42 can be applied over the shielding layer 38. The overcoat 42 is preferably abrasion resistant and moisture proof. While curable silicone materials generally may be satisfactory to form this layer, a particularly advantageous material is the polyester resins dissolved in a suitable carrier to be applied by overprinting.

The overcoat layer 42 can also be formed using the adhesively coated PET film disclosed for insulative layer 32. The PET or other similarly suitable polymeric film can include a second adhesive layer 46 and a removable release sheet 48 as shown in FIG. 7. The release sheet 48 is adapted to be removed to expose the adhesive layer 46 so as permit mounting of the finished product on other apparatus with which the device is intended to be used.

The completed assembly is easily die cut to the final desired configuration with a multiplicity of devices 10 being cut from a single substrate 12 and pin connectors 36 applied. In the embodiment shown in FIG. 8, the pin connector acts to electrically connect the shielding layer 38 to the conductor 22 which is then connected to a suitable ground. A suitable connector is AMP 88997-2.

The metal connectors 36 can be attached to the terminal portions of conductors 22 and 24 by stapling or other appropriate means. The spacing between the connector pins or elements 36 are set by the attaching equipment and by the spacing between the two second conductors 22 and 24 as well as on terminal 44 where present as a separate terminal element. When the two conductors 22 and 24 are simultaneously formed, the distance between the two conductors is uniformly maintained and hence the connection with the shielding layer 38 and spacing of the pin connectors 36 can also be similarly maintained with very high reliability.

Although the invention has been described in detail with reference to certain preferred embodiments, variations and modifications exist within the scope and spirit of the invention as described and is defined in the following claims:

What is claimed is:

1. The method of forming an electroluminescent device comprising the steps of:

(a) providing a substrate;

(b) depositing a first conductor on the substrate in a preselected pattern to form a first electrode;

(c) covering at least a first portion of the first conductor with a luminescent coating;

(d) depositing a pair of second conductors adjacent to each other, one of the pair of second conductors forming a second electrode and contacting only the luminescent coating and the substrate, the other of the pair of second conductors contacting only the first conductor and the substrate;

(e) depositing an insulative film so as to cover the pair of second conductors; and (f) depositing a conductive shielding layer over the insulative film, the shielding layer including a terminal portion adapted to be connected to a suitable ground.

2. The method of claim 1 wherein the terminal portion of the shielding layer is deposited on top of a terminal portion of one of said pair of second conductors.

3. The method of claim 2 further comprising the step of attaching a pin element to the terminal portion of each of the pair of second conductors, one of the pin elements electrically connecting the terminal portion of the shielding layer to the underlying terminal portion of a second conductor.

4. The method of claim 1 wherein the terminal portion of the shielding layer is deposited adjacent to the terminal portions of the pair of second conductors at a preselected spacing therefrom.

5. The method of claim 4 further comprising the step of attaching a pin element to the end of each of the second conductors and the shielding layer at a preselected spacing.

6. The method of claim 1 wherein step (c) leaves a second portion of the first conductor uncovered by the luminescent coating, and step (d) includes the simultaneous deposition of the second conductors, one of said second conductor extending along the second portion of the first conductor to form a bus for the first electrode.

7. The method of claim 1 wherein step (c) comprises the steps of depositing a mixture of a phosphor and a binder on the first portion of the first conductor; and depositing a mixture of a reflective opacifier in a matrix on the phosphor and binder mixture to reflect light emitted by the phosphor out through the substrate.

8. The method of claim 1 further comprising the step of applying a protective overcoat over the shielding layer.

9. The method of claim 1 wherein the protective overcoat includes an adhesive layer and a removable release sheet.

10. The method of claim 1 further comprising the step of cutting the device from a sheet of the substrate material.

11. The method of claim 1 wherein the preselected pattern in step (b) is one which forms a plurality of devices simultaneously on a single substrate.

* * * * *